United States Patent [19]

Giallourakis

[11] Patent Number: 4,742,582

[45] Date of Patent: May 10, 1988

[54] SEAT HANDLE ATTACHMENT

[76] Inventor: Anthony M. Giallourakis, P.O. Drawer 1307, Tarpon Springs, Fla. 33589

[21] Appl. No.: 916,794

[22] Filed: Oct. 8, 1986

[51] Int. Cl.[4] ..... A47K 17/00

[52] U.S. Cl. ..... 4/251; 4/661

[58] Field of Search ..... 4/251, 237, 242, 243, 4/661; 206/447, 813; 428/905; 16/114 R, 124; 224/901

[56] References Cited

U.S. PATENT DOCUMENTS

| | | | |
|---|---|---|---|
| 1,999,555 | 4/1935 | Adams | 4/251 |
| 2,758,315 | 8/1956 | Hylton | 4/251 |
| 3,191,193 | 6/1965 | Bogenberger | 4/251 |
| 3,279,331 | 10/1966 | Platt | 4/661 |
| 3,319,852 | 5/1967 | Perkins | 224/901 |
| 3,717,884 | 2/1973 | Mantooth | 4/251 |
| 3,783,455 | 1/1974 | Vanderbrook | 4/251 |
| 3,935,601 | 2/1976 | Hermann | 4/251 |
| 4,512,046 | 4/1985 | Riggle | 4/661 |
| 4,574,401 | 3/1986 | Nakajima | 4/251 |
| 4,576,311 | 3/1986 | Horton et al. | 206/447 |
| 4,606,956 | 8/1986 | Charbonneau et al. | 428/905 |

*Primary Examiner*—Henry J. Recla
*Assistant Examiner*—L. J. Peters
*Attorney, Agent, or Firm*—James C. Wray

[57] ABSTRACT

A sanitary seat handle has a planar portion for attachment to the underside of a toilet bowl seat. Another planar portion extends radially outward from the rim for maneuevering the seat up or down.

8 Claims, 1 Drawing Sheet

SEAT HANDLE ATTACHMENT

BACKGROUND OF THE INVENTION

The field of this invention relates to baths, closets, sinks, and spitoons, especially as these devices relate to seats and covers, covers for seats, seat and cover operators, closet-bowl closures, obstruction removers and closures, and miscellaneous apparatus as they relate to baths, closets, sinks and spitoons.

Toilet bowls, especially those in public places, are vehicles for communicating diseases. Because they are essential to a civilized routine life, they are tolerated and attempts are made to render them more sanitary or at least make them appear to be more sanitary.

Problem-solving in this area has been diverse and manifold. Some systems involve colored chemicals being slowly released into the bowl tanks to render the water sterile. It goes without saying that more synthetic chemicals in the human environment is not necessarily desireable. Sterile disposable paper coverings for seats are available and useful though such things are consumable and therefore an ongoing expense. Moreover, these seat covers do not address the problem of manipulating the seat up or down. There are foot-operated flusher assemblies so the user does not touch the toilet with his hand after using the bowl. However, the problem remains that when the seat is in the up position prior to use, it must be set down before use. If one were to use his foot to try and manipulate the seat, contaminants from around the floor of the bowl would be passed to the seat only to be spread to subsequent users. What is needed is a special appendage for the seat which can be manipulated by either the hand or the foot for handling the seat.

The present invention addresses this problem with such an appendage.

SUMMARY OF THE INVENTION

The invention is a seat handle for toilets whereby one may grab the handle and manipulate the toilet seat up and down without having to actually touch the toilet seat itself. The seat handle may be handled with either a foot or a hand. The invention comprises a rigid planar member having an oblong portion with an adhesive tape for attaching to the underside of the toilet seat. Extending from the oblong portion out beyond the rim of the toilet seat is a circular portion or a handle. The attachment portion or oblong portion is preferably oblong in shape so as to conform somewhat to the curved contours of the toilet seat while at the same time maximizing attached area for a sturdy anchor. It is preferred to attach the oblong portion by means of a double-sided slightly compressable adhesive tape which extends along much of the length of the oblong portion. Slow-releasing, volatile deodorants may be impregnated in part of this tape for the purpose of deodorizing. The points at which the circular portion extends from the oblong portion denote the points to be aligned with the outermost rim of the toilet seat edge.

It is an object of this invention to provide means for manipulating a toilet seat without having to touch the toilet seat with one's hands.

It is another object of this invention to render access to public facilities more sanitary.

It is an object of this invention to combine a seat handle with a deodorizing means.

Another object of the invention is to provide a seat handle attachment comprising a rigid planar member, wherein the planar member has an attachment portion and a handle portion, and wherein the attachment portion is wider than the handle portion for sturdy anchoring and the handle portion is longer than the attachment portion to facilitate handling and the attachment means are permanently affixed to the attachment portion, wherein the tape is a compressable sponge-like material having opposite sticky surfaces for sticking to the attachment portion and an underside section of a toilet seat, and for compensating for surface differences between a surface of the rigid planar member and a surface of the underside of the toilet seat and wherein the attachment portion has an oblongated shape to fit within curved contours of a toilet seat, and further has an inward curvilinear edge and outward curvilinear edges being aligned with an outward edge of a toilet seat.

Further objects and features of this invention will become apparent from the ongoing specification, drawings and claims.

DESCRIPTION OF THE PREFERRED EMBODIMENTS

Figure 1:
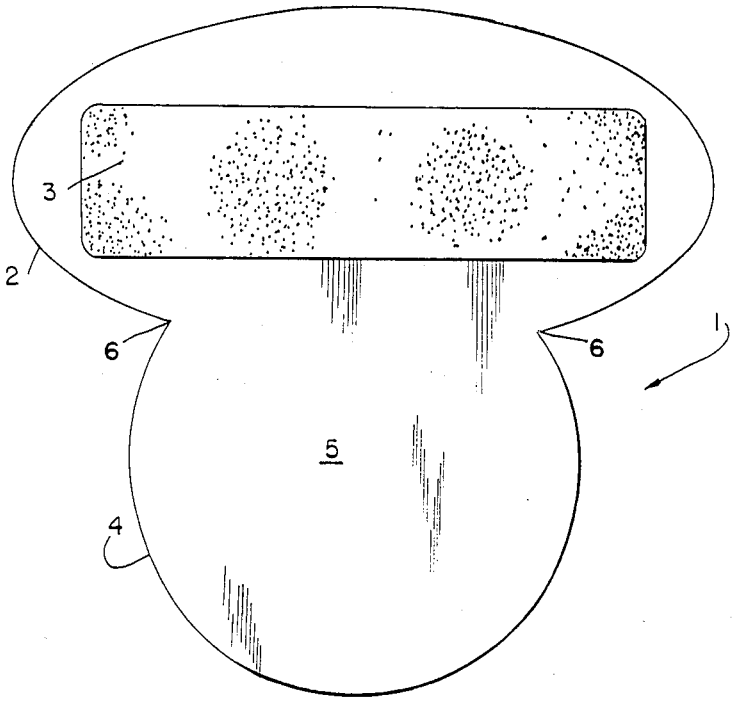
FIG. 1 is an elevated plan view of the invention.
Figure 2:
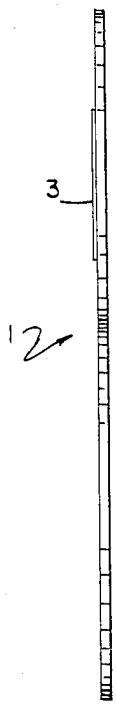
FIG. 2 is a side plan view of the invention.
Figure 3:
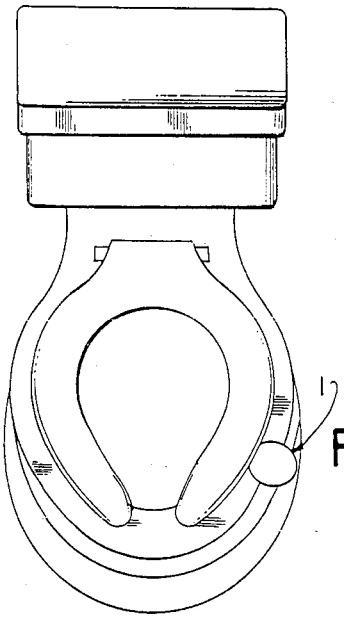
FIG. 3 is an elevated perspective of a toilet in combination with the invention.

The invention is disclosed in FIGS. 1, 2, and 3 and is denoted generally by the number 1. There is attachment portion 2, handle portion 4, and attachment means 3. Handle portion 2 is preferably oblongated so as to conform to toilet seat curvature. Preferably the section is 4.75 inches in length. Handle portion 4 is circular in shape and has a radius of 1.5 inches. The distance between points 7 and 8 is 4.5 inches. The distance from point 9 to point 8 is $2\frac{3}{8}$ inches.

Looking at FIG. 2, the invention is shown on its side, disclosing it to be a thin, rigid member having a thickness of 3/16 of an inch.

FIG. 3 discloses the invention in combination with the toilet seat.

It is preferred the seat handle attachment 1 be made of a hard rigid plastic such as any thermo-setting resin. The invention may be injection mold formed or cut from a sheet of material by way of a dye. The attachment means 3 is preferably a slightly compressable double-sided adhesive tape extending for most of the width of attachment portion 2. When not attached to the underside of a toilet seat, it is preferred the exposed sticky side of tape 3 be covered with a protective removable cover such as wax paper or the like.

Attaching the invention to the underside of a toilet seat is a simple matter. One merely would peel off the protective covering of the exposed sticky surface and attach the portion 2 to the underside of a toilet seat rim such that cusps 6 are aligned with the outermost rim leaving the substantial portion of handle portion 4, 5 exposed for easy access. It is preferred that raised lettering be attached to surface 5 to aid in gripping and to also denote purpose. It should be readily understood that the invention can be constructed out of other materials other than plastic without deviating from the spirit of the invention. For instance, the invention can be constructed out of a wood fiber or laminated rigidified cloth, rigidified cardboard, diverse composites, ceramics, etc. The invention is particularly useful in public areas where manipulation of the toilet facilities may be completely performed with the feet obviating the need for any hands to be touching the toilet.

In a preferred embodiment, attachment portion 2 has a curvilinear inner edge 8 that is spaced inwardly of edge 9 of a toilet seat 10, and oppositely curving outer edges 11 that are aligned with edge 9 of the toilet seat 10, and oppositely curving outer edges 11 that are aligned with edge 9 of the toilet seat 10 for attachment. The outer edges 8 assist in aligning the device for attachment to the toilet seat 10.

As this invention may be embodied in several forms without departing from the spirit or essential characteristics thereof, the present embodiment is therefore illustrative and not restrictive, and since the scope of the invention is defined by the appended claims, all changes that fall within the metes and bounds of the claims or that form their functional as well as conjointly cooperative equivalents are therefore intended to be embraced by those claims.

I claim:

1. A seat handle attachment, comprising:

(a) a rigid planar member, wherein said planar member has an attachment portion and a handle portion, and wherein said attachment portion is wider than said handle portion for sturdy anchoring and said handle portion is longer than the attachment portion to facilitate handling; and (b) attachment means permanently affixed to the attachment portion, wherein said attachment means comprises tape made of a compressable sponge-like material having opposite sticky surfaces for sticking to the attachment portion and an underside section of a toilet seat and for compensating for surface differences between a surface of the rigid planar member and a surface of the underside of the toilet seat, and wherein said attachment portion has an oblongated shape to fit within curved contours of a toilet seat, and further has an inward curvilinear edge and outward curvilinear edges, said outward curvilinear edges being aligned with an outward edge of a toilet seat and further comprises a scent-dispersing means having an impregnated volatile substance which releases slowly, wherein said scent-dispersing means is impregnated in said tape.

2. The device of claim 1 wherein said attachment means is a strip of tape extending along the majority of the length of the attachment portion.

3. The device of claim 2 wherein said tape is a compressable sponge-like material having opposite sticky surfaces for sticking to the attachment portion and an underside section of a toilet seat.

4. The device of claim 1 wherein said attachment portion has an oblongated shape to fit within curved contours of a toilet seat, and further has an inward curvilinear edge and outward curvilinear edges, said outward edges being aligned with an outward edge of a toilet seat.

5. The device of claim 4 wherein said handle portion is substantially circular in shape, whereby said seat handle attachment has an oblongated attachment portion being wider than a circular handle portion.

6. The device of claim 5 wherein said handle portion and said attachment portion form cusps where the circular and oblongate shapes meet.

7. The device of claim 6 wherein said rigid planar member is a piece of rigid material selected from the group consisting of plastic, wood, cardboard, and ceramic.

8. The device of claim 7 wherein said seat handle attachment is 3/16 of an inch thick.

* * * * *